US005437404A

United States Patent [19]

Shkolnikov

[11] Patent Number: 5,437,404

[45] Date of Patent: Aug. 1, 1995

[54] ADJUSTABLE SHEAR BLOCK ASSEMBLY

[75] Inventor: Yury Shkolnikov, Glenview, Ill.

[73] Assignee: Illinois Tool Works Inc., Glenview, Ill.

[21] Appl. No.: 91,180

[22] Filed: Jul. 13, 1993

[51] Int. Cl.[6] ..... B25C 5/00

[52] U.S. Cl. ..... 227/109; 227/119; 227/120

[58] Field of Search ..... 227/109, 119, 120, 139, 227/142

[56] References Cited

U.S. PATENT DOCUMENTS

| | | | |
|---|---|---|---|
| Re. 32,452 | 7/1987 | Nikolich | 123/46 |
| 1,744,700 | 1/1930 | Hubbard et al. | 227/132 |
| 2,991,476 | 7/1961 | Seiter | 227/109 |
| 4,369,909 | 1/1983 | Grzeika | 227/109 |
| 4,572,419 | 2/1986 | Klaus et al. | 227/120 |
| 4,753,382 | 6/1988 | Bajpai et al. | 227/109 |
| 4,815,647 | 3/1989 | Chou | 227/109 |
| 4,858,812 | 8/1989 | Fealey | 227/116 |
| 5,005,730 | 4/1991 | Scala | 227/109 |
| 5,096,109 | 3/1992 | Chen | 227/109 |

FOREIGN PATENT DOCUMENTS

| | | | |
|---|---|---|---|
| 0745458 | 2/1965 | United Kingdom | 227/109 |

OTHER PUBLICATIONS

Senco SN325t Operating Instructions, Apr. 1992.

*Primary Examiner*—Eugenia Jones
*Assistant Examiner*—Allan M. Schrock
*Attorney, Agent, or Firm*—Schwartz & Weinrieb

[57] ABSTRACT

An adjustable shear block for guiding fasteners of at least two different lengths as they are driven by a fastener driving tool includes a shear block guide surface connected to the shear block which can be manipulated between a first position for driving substantially longer fasteners and a second position for driving substantially shorter fasteners and prevent the shorter fasteners from tipping or tumbling as they are driven.

20 Claims, 2 Drawing Sheets

Fig. 1
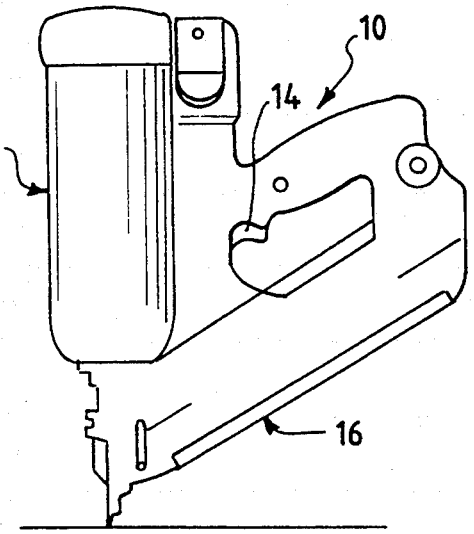
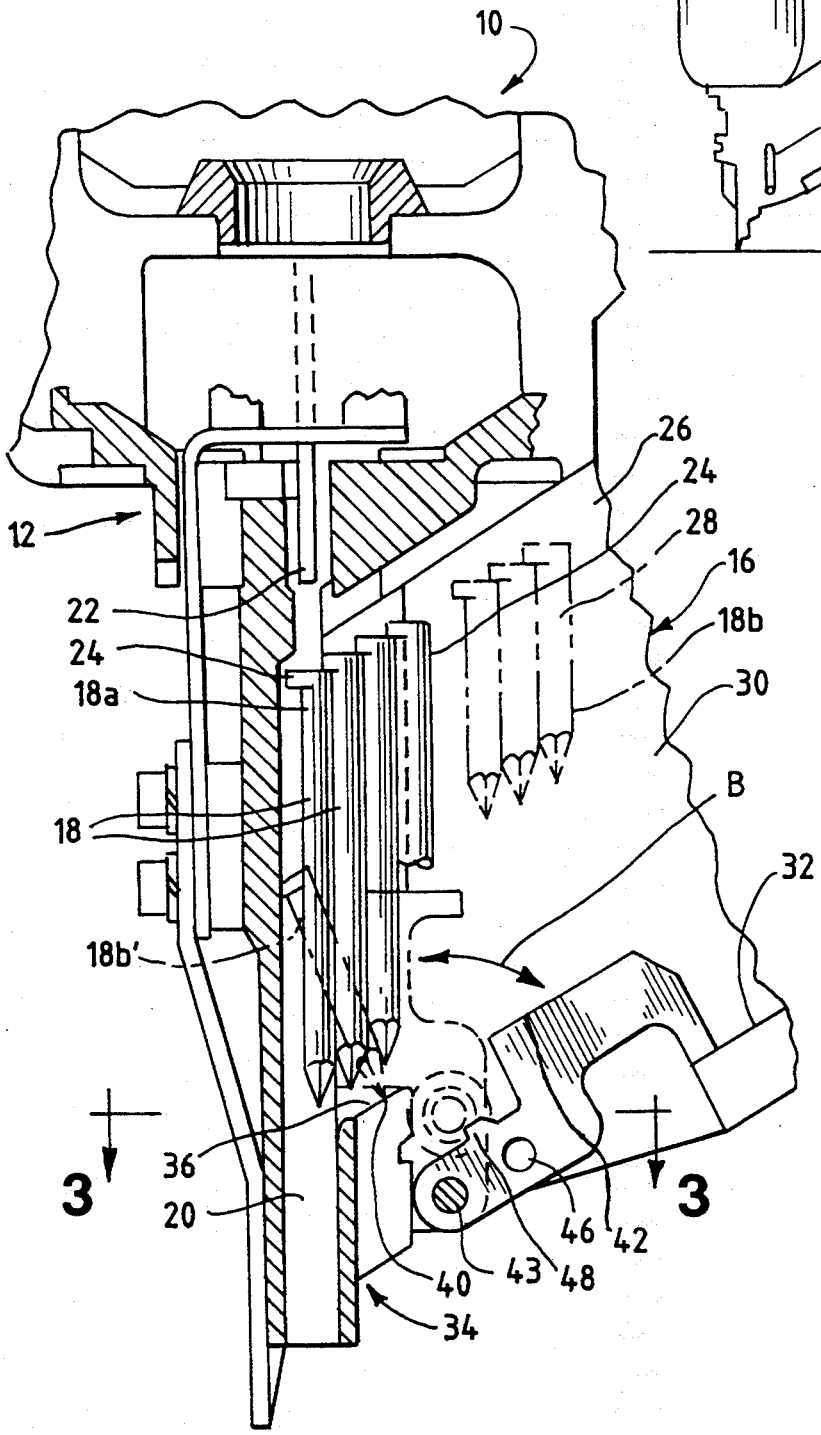
Fig. 2

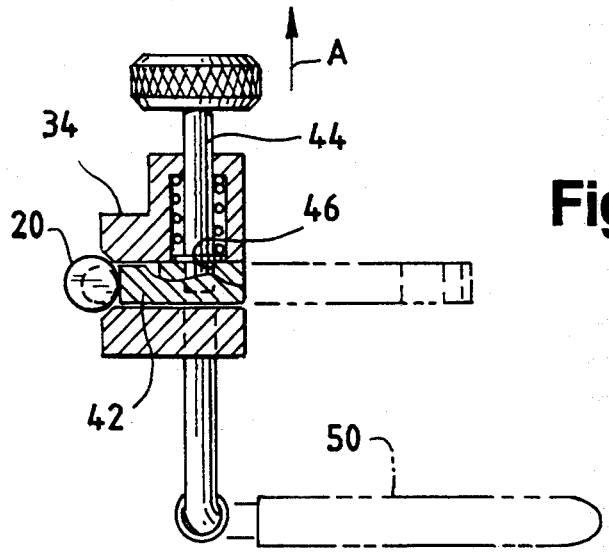
Fig. 3
Fig. 4
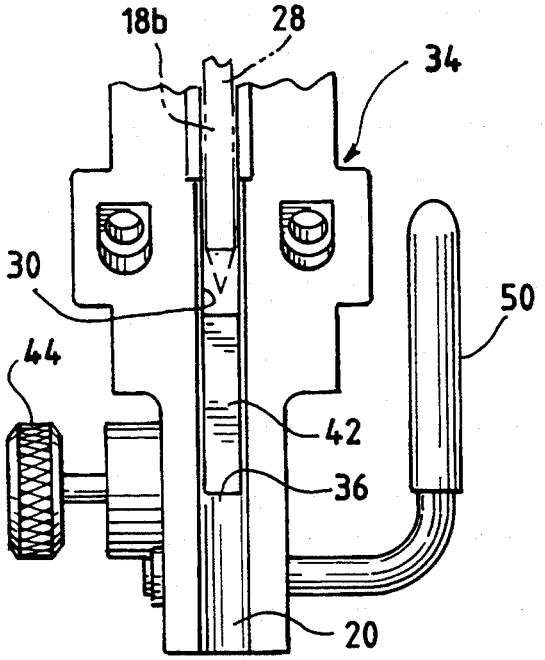
Fig. 5
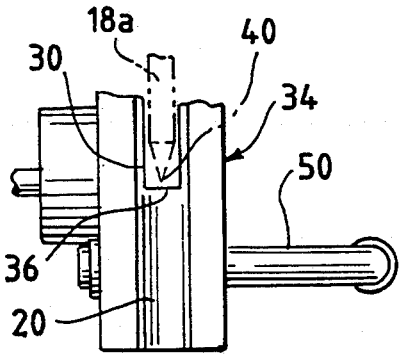

ADJUSTABLE SHEAR BLOCK ASSEMBLY

BACKGROUND OF THE INVENTION

1. Field of the Invention

The present invention relates generally to self-contained or cordless tools, and more particularly to a cordless tool for driving a fastener, such as a nail, staple or the like, into a desired surface which includes an adjustable shear block assembly which can be readily manipulated by a user to accommodate fasteners of at least two different lengths so as to provide accurate guiding of the fasteners without requiring a user to connect any additional parts to the tool.

2. Description of the Related Art

An example of a cordless tool for driving fasteners is illustrated in U.S. Pat. No. Re. 32,452 which is owned by the assignee herein. That tool utilizes an internal combustion motor to drive a nail or the like into a desired surface and includes a magazine for holding a plurality of fasteners. The fasteners are typically are collated into a strip, are positioned within a feed slot or track in the magazine and are sequentially are advanced into a driving position within a bore of the tool. A shear block or guide surface is included between the magazine and the bore for separating the fastener in the bore from the adjacent fastener in the magazine and guiding the fastener in the bore as it is being driven.

Although that tool and magazine can accommodate nails of different lengths, substantially small nails can occasionally slightly tip or tumble toward the magazine feed slot as they are being driven. Such tumbling can cause inaccurate driving of the nail and possible jamming of the nail within the tool.

One way to reduce tumbling of small nails is to provide a plurality of nail head feed tracks or slots in the magazine and shear block, one each for a different length fastener. An example of such a multiple nail head feed track tool is illustrated in U.S. Pat. No. 5,005,750 which discloses a magazine and shear block having a plurality of parallel feed slots for nail heads and a separate insert strip which is inserted by a user to enable pins or brads to advance without play.

Another type of multiple feed track magazine is illustrated in U.S. Pat. No. 5,096,109 which discloses a magazine having an axial shaft including a plurality of axial grooves of various depths where the shaft is rotatable to adjust the magazine for accommodating heads of different length brads.

With both of the above referenced patents, however, the magazine is bulky and care must be taken to insure that the appropriate slot is utilized for a given nail. Additionally, the tool in both of these patents varies the point of impact with the fastener which can affect the driving of the fastener, especially with tools which provide adjustable driving depths.

Another way of reducing tumbling is to provide a separate magazine nail guide insert which can be affixed at the exit end of the magazine by a user to guide small nails as they are driven. An example of a separate nail guide is illustrated in sales brochure No. NFD842 of Senco Products, Inc., for a SN325+ Framing Nailer. Such a separate nail guide insert, however, is not permanently attached to the tool which makes it difficult to install on the job site and raises the possibility of losing the nail guide.

It therefore would be desirable to provide a magazine and shear block having a single fastener feed slot and an adjustable shear block guide surface which is permanently attached to the tool and can be readily actuated by a user to accommodate fasteners of different lengths and prevent tumbling of substantially smaller fasteners as they are being driven.

SUMMARY OF THE INVENTION

The invention provides an adjustable shear block for guiding fasteners of at least two different lengths as they are driven by a fastener driving tool. The shear block includes a shear block guide surface connected to the shear block which can be manipulated between a first position for driving substantially longer fasteners and a second position for driving substantially shorter fasteners and prevent said shorter fasteners from tipping or tumbling as they are driven. Preferably, a single fastener feed slot is utilized.

To assist in positioning the guide surface in the first and second positions, a selector lever can be included which is accessible to a user from the exterior of the tool. A spring loaded retractor pin can also be included for locking the guide surface in the first and second positions.

BRIEF DESCRIPTION OF THE DRAWINGS

Various other objects, features, and attendant advantages of the present invention will be more fully appreciated from the following detailed description, when considered in connection with the accompanying drawings, in which like reference characters designate like or corresponding parts throughout the several views, and wherein:

FIG. 1 is a side elevational view of a cordless tool which utilizes the adjustable shear block of the present invention;

FIG. 2 is a partial cross-sectional view of the tool of FIG. 1 illustrating the adjustable shear block of the invention;

FIG. 3 is a partial cross-sectional view of the tool taken along lines 3—3 of FIG. 2 and in the direction indicated generally;

FIG. 4 is a partial front elevational view of the adjustable shear block of the invention illustrated for use with a smaller fastener; and FIG. 5 is a partial front elevational view of the adjustable shear block of the invention, similar to FIG. 4, illustrating the shear block positioned for use with a longer fastener.

DESCRIPTION OF THE PREFERRED EMBODIMENTS

FIG. 1 generally illustrates a cordless fastener gun 10 which is utilized in conjunction with the assembly of the present invention. The gun 10 substantially includes a driving mechanism 12 activated by a trigger 14 and a fastener magazine assembly 16.

Briefly, in operation, as FIG. 2 illustrates a plurality of fasteners 18, such as nails, are disposed within the magazine assembly 16 and are arranged in successive alignment. A first fastener 18*a* is positioned by the magazine 16 within a bore 20 of the driving mechanism 12. Upon activation of the trigger 14, a fastener driving piston 22 of the driving mechanism 12 is driven downward with respect to FIG. 2 thereby contacting the fastener 18a to drive it down the bore 20 and into a desired surface.

The magazine 16 is capable of holding a number of fasteners 18 and is also capable of sequentially advancing each fastener 18 into the bore 20 for driving of the same. Preferably, the fasteners 18 are interconnected in strips or blocks of predetermined quantities. When the fastener 18*a* is driven, it is broken away from the remaining fasteners 18. To maintain the fasteners 18 interconnected in strips, an adhesive, tape or similar connecting method is utilized.

Each fastener 18, regardless of its length, is suspended by its head 24 in a single slot 26 of the magazine 16 with the shank 28 of each fastener 18 suspended in a channel 30. Both the slot 26 and channel 30 extend the length of the magazine 16 with the channel 30 being defined on one side by the slot 26 and on an opposite side by a bottom surface 32.

As FIGS. 2 and 4 illustrate, to guide each fastener 18 as it is being driven, a shear block 34 is provided which is preferably integrally connected to the magazine 16, forms one side of the bore 20 and includes the slot 26 and channel 30 extending therethrough. The shear block 34, however, can be affixed to the driving mechanism 12, if desired.

The magazine 16, shear block 34 and bore 20 can accommodate substantially long fasteners 18*a*, illustrated in solid lines, as well as substantially short fasteners 18*b*, illustrated in dotted lines. When a substantially short fastener 18*b* is utilized a potential tumbling problem can occasionally occur during driving of the fastener 18*b* due to the height of the channel 30. As a fastener 18*b* is being driven, the shank 28 can rotate slightly to the right with respect to FIG. 2, as illustrated by the fastener 18*b*′, causing the point 40 of the fastener 18*b*′ to engage the bottom 36 of the shear block 34.

In order to prevent such tumbling, the shear block 34 includes an adjustable guide surface 42 which is connected for rotation with respect to the shear block 34 about an axis 43. As FIG. 2 illustrates, the guide surface 42 rotates within the channel 30 from a first position, illustrated in solid lines, to a second position, illustrated in dotted lines. FIGS. 5 and 4 illustrate the first and second positions, respectively, of the guide surface 42 where longer fasteners 18*a* are driven in the first position and shorter fasteners 18*b* are driven in the second position.

As FIG. 3 illustrates, to lock the guide surface 42 in either the first or second position, a spring loaded retractor pin 44 is included. When the guide surface 42 is rotated to the second position, the pin 44 seats within an aperture or recess 46 in the guide surface 42. When the guide surface 42 is rotated to the first position, the pin 44 seats behind a finger portion 48 of the guide surface 42 as illustrated in FIG. 2. To assist in rotation of the guide surface 42, a selector lever 50 can be included.

In use, when a substantially long fastener 18*a* is to be driven by the gun 10, the guide surface 42 is rotated to the first position illustrated in solid lines in FIG. 2 and in FIG. 5. In this position, substantially the entire height of the channel 30 can be utilized to accept a fastener 18*a*.

When a substantially short fastener 18*b* is to be driven by the gun 10, a user merely pulls out the spring loaded retractor pin 44 in the direction of arrow "A" of FIG. 3, grasps the selector lever 50 and rotates the selector lever 50 and guide surface 42 upward with respect to FIG. 3, substantially in the direction of arrow "B" of FIG. 2, to the second position illustrated in dotted lines. In this position, also illustrated in FIG. 4, the height of the channel 30 is shortened within the shear block 34 by the guide surface 42 to prevent any tumbling of the fastener 18*b* which may occur.

It is to be noted that the size of the guide surface 42 and channel 30 can be modified to accommodate fasteners 18 of any length. Additionally, the specific size of the fasteners 18*a* and 18*b* can vary within a predetermined range without affecting the operation of the gun 10. Thus, more than two exact sizes of fasteners 18 can be utilized by the gun 10. It is also conceivable within the scope of the invention that the assembly can be modified to accommodate more than two different size ranges of fasteners 18.

Modifications and variations of the present invention are possible in light of the above teachings. It therefore is to be understood that within the scope of the appended claims the invention may be practiced otherwise than as specifically described.

What is claimed and desired to be secured by letters patent is:

1. An apparatus for guiding fasteners of at least two different longitudinal lengths as they are moved through an exit of a fastener magazine and into a driving bore so as to be driven by a fastener driving tool, comprising:

shear block guide surface means movably connected to a shear block for movement between a first operative position at which said shear block guide surface means is disposed out of alignment with respect to said driving bore for permitting driving of fasteners having a first longitudinal length, and a second operative position at which said shear block guide surface means is substantially in alignment with a wall defining said driving bore for effectively shortening the length of said exit of said fastener magazine so as to permit driving of fasteners having a second longitudinal length, which is shorter than said first longitudinal length, while preventing said fasteners of said second longitudinal length from tipping or tumbling as said fasteners of said second longitudinal length are driven.

2. The apparatus as defined in claim 1, wherein:

said shear block guide surface means is pivotably connected to said shear block for pivotable movement by a user between said first and second operative positions.

3. The apparatus as defined in claim 2, wherein:

said shear block guide surface means includes a selector lever connected thereto and accessible from the exterior of said tool for assisting a user in pivoting said shear block guide surface means between said first and second operative positions.

4. The apparatus as defined in claim 1 including a single fastener feed slot defined within said magazine.

5. An apparatus as set forth in claim 1, wherein:

said shear block guide surface means is pivotably connected to said shear block for pivotable movement between said first and second operative positions.

6. An apparatus as set forth in claim 1, further comprising:

means operably connected to said shear block and engageable with said shear block guide surface means for locking said shear block guide surface means at said first and second operative positions.

7. An apparatus set forth in claim 1, further comprising:

a selector lever operatively connected to said shear block guide surface means and accessible from the exterior of said tool for facilitating movement of said shear block guide surface means between said first and second operative positions.

8. A tool, for driving a fastener into a surface, which accommodates fasteners of at least two different longitudinal lengths, comprising:

fastener driving means for driving a fastener through a driving bore of said tool and into a desired surface;

a fastener magazine, operatively connected to said driving bore by a single fastener feed exit for accommodating fasteners of different longitudinal lengths and having means for successively advancing a desired fastener into said driving bore so as to be driven by said fastener driving means; and an adjustable shear block having a shear block guide surface means movably mounted upon said shear block for movement between a first operative position at which said shear block guide surface means is disposed out of alignment with respect to said driving bore for permitting driving of fasteners having a first longitudinal length, and a second operative position at which said shear block guide surface means is substantially in alignment with a wall defining said driving bore for effectively shortening the length of said exit of said fastener magazine so as to permit driving of fasteners having a second longitudinal length, which is shorter than said first longitudinal length, while preventing tipping or tumbling of said fasteners of said second longitudinal length during driving of said fasteners of said second longitudinal length by said driving means.

9. The tool as defined in claim 8, wherein:

said shear block guide surface means is pivotably connected to said shear block for pivotable movement by a user between said first and second operative positions.

10. The tool as defined in claim 9 wherein said fastener is at least one of a nail and a staple.

11. The tool as defined in claim 7, further including, a selector lever connected to said shear block guide surface means and accessible from the exterior of said tool for assisting a user in pivoting said shear block guide surface means between said first and second operative positions.

12. The tool as defined in claim 9 wherein said shear block can accommodate fasteners having said first and second longitudinal lengths that vary within at least two predetermined ranges, respectively.

13. The tool as defined in claim 8 wherein said tool is a self-contained cordless tool.

14. A driving tool as set forth in claim 8, further comprising:

means operably connected to said shear block and engageable with said shear block guide surface means for locking said shear block guide surface means at said first and second operative positions.

15. An apparatus for guiding fasteners of at least two different longitudinal lengths as they are moved through an exit of a fastener magazine and into a driving bore so as to be driven by a fastener driving tool, comprising:

shear block guide surface means movably connected to said shear block for movement between a first operative position at which said shear block guide surface means is disposed out of alignment with respect to said driving bore for permitting driving of fasteners having a first longitudinal length, and a second operative position at which said shear block guide surface means is substantially in alignment with a wall defining said driving bore for effectively shortening the length of said exit of said fastener magazine so as to permit driving of fasteners having a second longitudinal length, which is shorter than said first longitudinal length, while preventing said fasteners of said second longitudinal length from tipping or tumbling as said fasteners of said second longitudinal length are driven; and a spring loaded retractor pin operably connected to said shear block for locking said shear block guide surface means at said first and second positions.

16. An apparatus as set forth in claim 14, further comprising:

a selector lever operatively connected to said shear block guide surface means and accessible from the exterior of said tool for facilitating movement of said shear block guide surface means between said first and second operative positions.

17. A tool, for driving a fastener into a surface, which accommodates fasteners of at least two different longitudinal lengths, comprising:

fastener driving means for driving a fastener through a driving bore of said tool and into a desired surface;

a fastener magazine, operatively connected to said driving bore by a single fastener feed exit, for accommodating fasteners of different longitudinal lengths and having means for successively advancing a desired fastener into said driving bore so as to be driven by said fastener driving means;

an adjustable shear block having a shear block guide surface means movably connected to said shear block for movement between a first operative position at which said shear block guide surface means is disposed out of alignment with respect to said driving bore for permitting driving of fastener having a first longitudinal length, and a second operative position at which said shear block guide surface means is substantially in alignment with a wall defining said driving bore for effectively shortening the length of said exit of said fastener magazine so as to permit driving of fasteners having a second longitudinal length, which is shorter than said first longitudinal length, while preventing tipping or tumbling of said fasteners of said second longitudinal length during driving of said fasteners of said second longitudinal length by said driving means; and a spring load retractor pin operably connected to said shear block for locking said shear block guide surface means at said first and second positions.

18. An apparatus as set forth in claim 15, wherein:

said shear block guide surface means is pivotably connected to said shear block for pivotable movement between said first and second operative positions.

19. A driving tool as set forth in claim 17, wherein:

said shear block guide surface means is pivotably connected to said shear block for pivotable movement between said first and second operative positions.

20. A tool as set forth in claim 17, further comprising:

a selector lever operatively connected to said shear block guide surface means and accessible from the exterior of said tool for facilitating movement of said shear block guide surface means between said first and second operative positions.

* * * * *